US009812112B2

(12) United States Patent
Wochner et al.

(10) Patent No.: US 9,812,112 B2
(45) Date of Patent: Nov. 7, 2017

(54) INJECTION MOLDED NOISE ABATEMENT ASSEMBLY AND DEPLOYMENT SYSTEM

(71) Applicants: Mark S. Wochner, Austin, TX (US); Andrew R. McNeese, Austin, TX (US); Kevin M. Lee, Austin, TX (US); Preston S. Wilson, Austin, TX (US)

(72) Inventors: Mark S. Wochner, Austin, TX (US); Andrew R. McNeese, Austin, TX (US); Kevin M. Lee, Austin, TX (US); Preston S. Wilson, Austin, TX (US)

(73) Assignee: Board of Regents, The University of Texas System, Austin, TX (US)

( * ) Notice: Subject to any disclaimer, the term of this patent is extended or adjusted under 35 U.S.C. 154(b) by 0 days.

(21) Appl. No.: 15/185,856

(22) Filed: Jun. 17, 2016

(65) Prior Publication Data

US 2016/0372101 A1 Dec. 22, 2016

Related U.S. Application Data

(60) Provisional application No. 62/181,374, filed on Jun. 18, 2015.

(51) Int. Cl.

| | |
|---|---|
| ***G10K 11/172*** | (2006.01) |
| ***E21B 41/00*** | (2006.01) |
| *E02B 17/00* | (2006.01) |

(52) U.S. Cl.

CPC ..... *G10K 11/172* (2013.01); *E21B 41/0007* (2013.01); *E02B 17/0017* (2013.01); *G10K 2200/11* (2013.01)

(58) Field of Classification Search

CPC .. E01F 8/00; E01F 8/0017; B64F 1/26; G10K 11/172

USPC ..... 181/210

See application file for complete search history.

(56) References Cited

U.S. PATENT DOCUMENTS

| | | | | |
|---|---|---|---|---|
| 3,022,632 A * | 2/1962 | Parks | E02B 3/062 405/26 |
| 3,487,645 A * | 1/1970 | Frankel | E02B 3/062 405/26 |
| 5,457,291 A * | 10/1995 | Richardson | B28B 23/0068 181/293 |
| 5,587,564 A | 12/1996 | Stief et al. | |

(Continued)

OTHER PUBLICATIONS

Wochner et al., "Attenuation of low frequency underwater noise using arrays of air-filled resonators", Inter-noise Nov. 2014, Melbourne, Australia.

(Continued)

*Primary Examiner* — Forrest M Phillips

(74) *Attorney, Agent, or Firm* — Intrinsic Law Corp.

(57) ABSTRACT

Acoustic resonators are formed by injection molding or other process that allows the shape, size, orientation, and arrangement of each resonator to be customized. Customizing the features of the resonators allows their resonance frequency to be adjusted based on their intended deployment. A non-periodic or non-uniform arrangement of the resonators can increase the level of noise reduction compared to a periodic or uniform arrangement of the resonators. A chain guard includes a recess to receive a chain that supports a plurality of resonator rows or frames. In the stowed configuration, the chain guard pivots towards the row/frame to more compactly stow a panel of resonators.

27 Claims, 22 Drawing Sheets

(56) References Cited

U.S. PATENT DOCUMENTS

| | | | | |
|---|---|---|---|---|
| 7,686,539 | B2 * | 3/2010 | Aristaghes | E02B 3/06 405/27 |
| 8,387,746 | B2 * | 3/2013 | Parkin | A01K 61/00 181/290 |
| 8,662,249 | B2 * | 3/2014 | Nair | G10K 11/168 181/284 |
| 8,887,864 | B2 * | 11/2014 | Sugimoto | B61D 17/185 181/284 |
| 9,343,059 | B2 * | 5/2016 | Wilson | G10K 11/172 |
| 9,410,403 | B2 * | 8/2016 | Wochner | E21B 41/0007 |
| 9,488,026 | B2 * | 11/2016 | Wochner | E21B 33/10 |
| 2003/0006090 | A1 * | 1/2003 | Reed | E01F 8/007 181/210 |
| 2005/0167193 | A1 * | 8/2005 | Van Reeth | E01F 8/0082 181/293 |
| 2010/0243369 | A1 * | 9/2010 | Fusiek | E01F 8/007 181/210 |
| 2013/0001010 | A1 | 1/2013 | Wilson et al. | |
| 2013/0299274 | A1 | 11/2013 | Ayle | |
| 2015/0078833 | A1 * | 3/2015 | Elmer | E02D 13/00 405/195.1 |
| 2015/0083520 | A1 * | 3/2015 | Wilson | G10K 11/172 181/212 |

OTHER PUBLICATIONS

U.S. International Searching Authority, "International Search Report—PCT/US16/38096", dated Sep. 16, 2016, WIPO.

* cited by examiner 2100A
2100B

INJECTION MOLDED NOISE ABATEMENT ASSEMBLY AND DEPLOYMENT SYSTEM

TECHNICAL FIELD

The present disclosure relates to noise abatement devices for reduction of underwater sound emissions, such as noise from seafaring vessels, oil and mineral drilling operations, and marine construction and demolition.

RELATED APPLICATIONS

This application claims priority to U.S. Provisional Application No. 62/181,374, filed on Jun. 18, 2015, entitled "Injection Molded Noise Abatement Assembly and Deployment System," which is hereby incorporated by reference.

BACKGROUND

Various underwater noise abatement apparatuses have been proposed. Some are embodied in a form factor that encloses or is deployed at or near a source of underwater noise. U.S. Patent Application Publication Number 2011/0031062, entitled "Device for Damping and Scattering Hydrosound in a Liquid," describes a plurality of buoyant gas enclosures (balloons containing air) tethered to a rigid underwater frame that absorb underwater sound in a frequency range determined by the size of the gas enclosures. Patent application U.S. Patent Application Publication Number 2015/0170631, entitled "Underwater Noise Reduction System Using Open-Ended Resonator Assembly and Deployment Apparatus," discloses systems of submersible open-ended gas resonators that can be deployed in an underwater noise environment to attenuate noise therefrom. These and their related applications and documentation are incorporated herein by reference.

Underwater noise reduction systems are intended to mitigate man-made noise so as to reduce its environmental impact. Pile driving for offshore construction, oil and gas drilling platforms, and seafaring vessels are examples of noise that can be undesirable and that should be mitigated. However, the installation, deployment and packaging of underwater noise abatement systems can be challenging, as these apparatuses are typically bulky and cumbersome to store and deploy.

In addition, current noise reduction systems rely on a combination of materials, such as rubber, plastic, and/or metal. Systems constructed from non-homogenous systems can be costlier to manufacture than homogenous systems manufactured from a single material.

The present application relates to underwater noise reduction devices and systems and methods of storing and deploying such devices.

SUMMARY

Example embodiments described herein have innovative features, no single one of which is indispensable or solely responsible for their desirable attributes. The following description and drawings set forth certain illustrative implementations of the disclosure in detail, which are indicative of several exemplary ways in which the various principles of the disclosure may be carried out. The illustrative examples, however, are not exhaustive of the many possible embodiments of the disclosure. Without limiting the scope of the claims, some of the advantageous features will now be summarized. Other objects, advantages and novel features of the disclosure will be set forth in the following detailed description of the disclosure when considered in conjunction with the drawings, which are intended to illustrate, not limit, the invention.

In an aspect, the invention is directed to a resonator for damping acoustic energy from a source in a liquid. The resonator includes a base having a first planar surface and a second planar surface, said first and second planar surfaces parallel with one another. The resonator also includes a hollow body having, in a cross section orthogonal to said second planar surface of said base, a first end, a second end, and a sidewall therebetween, said second end integrally connected to said second surface of said base, said body having an aperture defined in said first end, said aperture extending from said first end to said second end, said aperture defining a volume in said hollow body, said hollow body configured to retain a gas in said volume when said resonator is disposed in said liquid while said aperture is aligned with a direction of gravitational pull.

In another aspect, the invention is directed to an apparatus for damping acoustic energy from a source in a liquid. The apparatus includes a base having a first planar surface and a second planar surface, said first and second planar surfaces parallel with one another. The apparatus also includes a plurality of hollow bodies, each hollow body having, in a cross section orthogonal to said second planar surface, a first end, a second end, and a sidewall therebetween, said second end integrally connected to said second surface of said base, said body having an aperture defined in said first end, said aperture extending from said first end to said second end, said aperture defining a volume in said hollow body, said hollow body configured to retain a gas in said volume when said resonator is disposed in said liquid while said aperture is aligned with a direction of gravitational pull. The apparatus also includes a plurality of holes defined in said base, said holes disposed between at least some of said hollow bodies.

In another aspect, the invention is directed to a noise abatement system. The system includes a plurality of collapsible frames. The system also includes a chain passing through an aperture defined in each collapsible frame, said chain mechanically connecting and supporting said collapsible frames. The system also includes a plurality of elongated chain guards, each chain guard pivotally connected to said frame proximal to said aperture, said chain guard having a body that defines a recess along a length of said chain guard to at least partially receive the chain, said chain guard configured to pivot (a) from an open position wherein said length of said chain guard is orthogonal to said respective frame (b) to a closed position wherein said length of said chain guard is parallel to said respective frame. The system also includes a plurality of resonators disposed on each said frame, each resonator including a hollow body having an open end, a closed end, and a sidewall therebetween, said closed end integrally connected to a first surface of a base disposed on said respective frame.

IN THE DRAWINGS

For a fuller understanding of the nature and advantages of the present invention, reference is made to the following detailed description of preferred embodiments and in connection with the accompanying drawings, in which.

DETAILED DESCRIPTION

Figure 1:
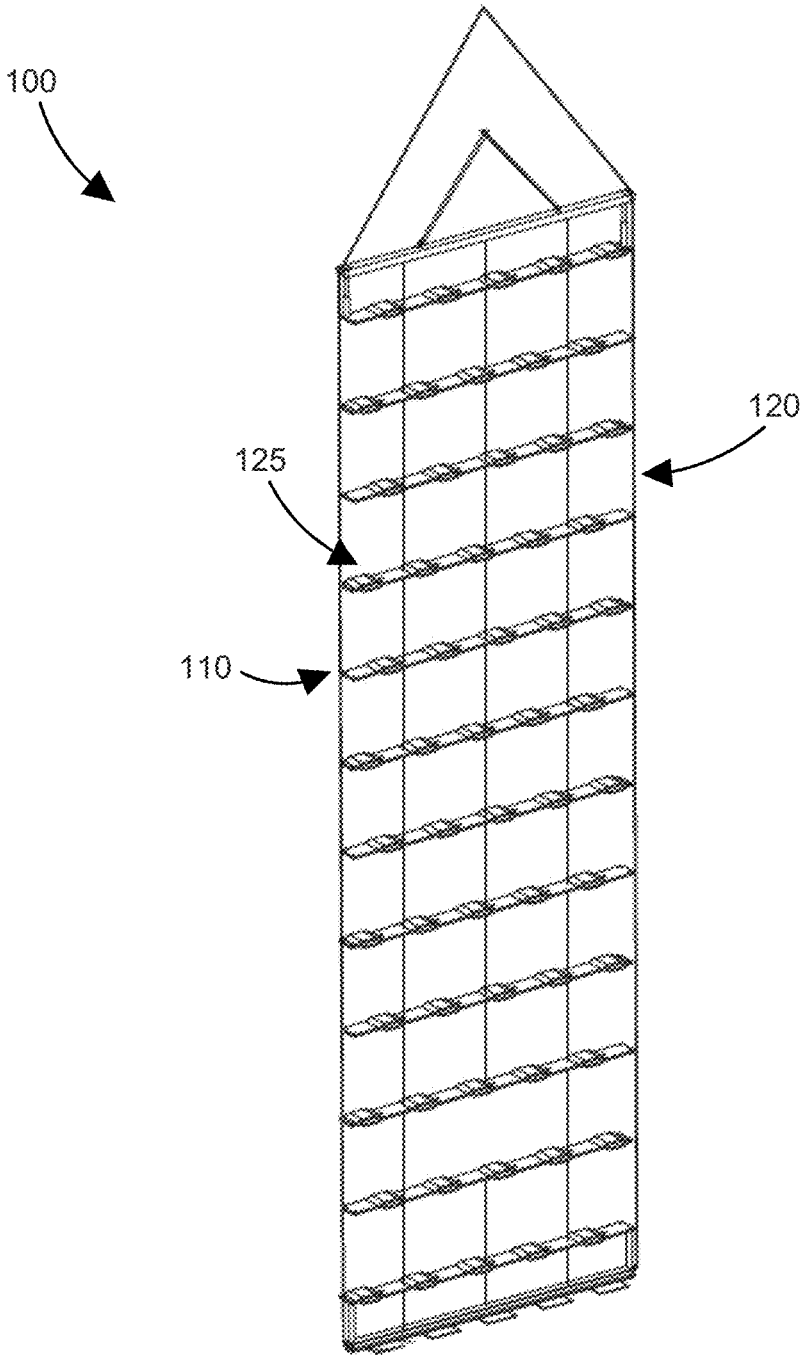
FIG. 1 illustrates an underwater noise reduction apparatus according to an embodiment.

FIG. 1 illustrates an underwater noise reduction apparatus 100 according to an embodiment. The noise reduction apparatus 100 can be lowered into a body of water around or proximal to a noise-generating event or thing such as a drilling platform, ship, or other machine. A plurality of resonators 125 disposed on a vertically-deployed panel of the noise reduction apparatus 100 resonate so as to absorb sound energy and therefore reduce the radiated sound energy emanating from the location of the noise-generating event or thing. The resonators 125 include a cavity to retain a gas, such as air, nitrogen, argon, or combination thereof in some embodiments. For example, the resonators 125 can be the type of resonators disclosed in U.S. Ser. No. 14/494,700, filed on Sep. 24, 2014, entitled "Underwater Noise Abatement Panel and Resonator Structure," which is hereby incorporated herein by reference. In some embodiments, the resonators 125 are arranged in a two- or three-dimensional array. The resonators 125 can be arranged in rows 110, and each row can be connected to the adjacent row(s) by a plurality of lines 120.

The apparatus 100 can be towed behind a noisy sea faring vessel. Several such apparatuses can be assembled into a system for reducing underwater noise emissions from the vessel. Also, a system like this can be assembled around one or more facets of a mining or drilling rig.

Figure 2:
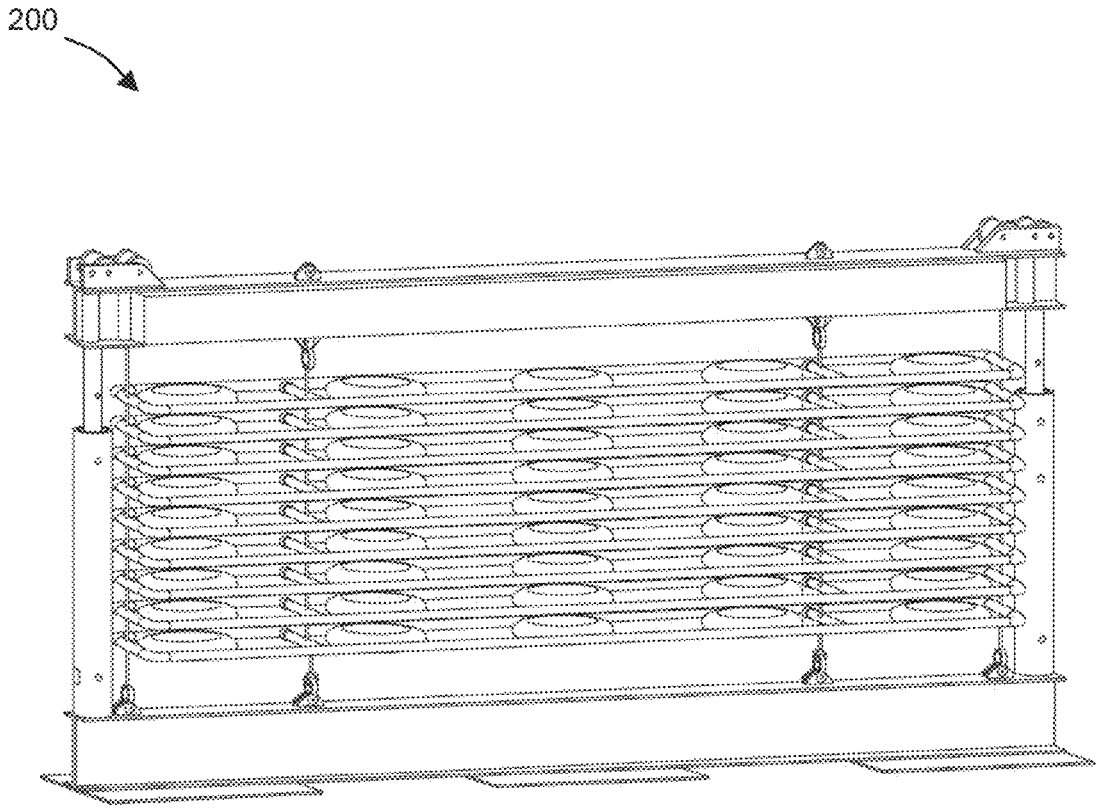
FIG. 2 illustrates an an example of a panel on resonators in a collapsed or stowed configuration according to an embodiment.

The noise reducing apparatus 100 can be expandable and deployable, for example as described in U.S. Ser. No. 14/590,177, filed on Jan. 6, 2015, entitled "Underwater Noise Abatement Apparatus and Deployment System," which is hereby incorporated herein by reference. One or more lines connecting each row of the resonator panel can be raised or lowered, which can cause the panel to collapse vertically, similar to a venetian blind. An example of a panel 200 in a collapsed or stowed configuration is illustrated in FIG. 2.

Figure 3:
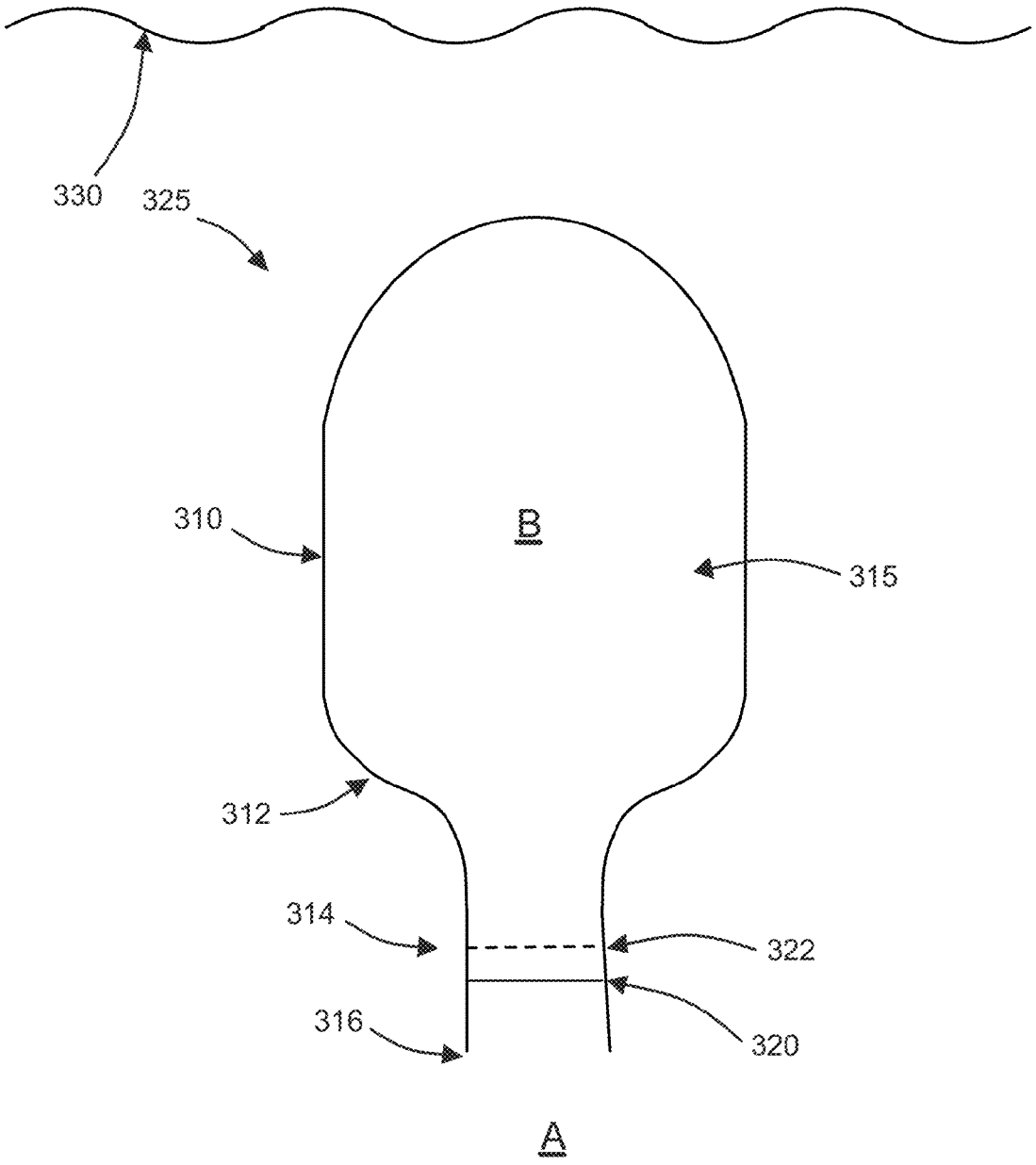
FIG. 3 illustrates an example of an acoustic resonator that can be disposed on the apparatus of FIG. 1.

FIG. 3 illustrates an example of an acoustic resonator 325 that can be disposed on apparatus 100. The resonator 325 is applied to a two-fluid environment where a first fluid is represented in the drawing by "A" and the second fluid is represented by "B." For the purpose of illustration only, the two-fluid environment can be a liquid-gas environment. In a more particular illustrative example, the liquid 330 may be water and the gas may be air. In a yet more particular example, the liquid may be sea water (or other natural body of water) and the gas may be atmospheric air. For example, the first fluid "A" can be sea water and the second fluid "B" can be air.

An embodiment of resonator 325 has an outer body or shell 310 with a main volume 315 of fluid B contained therein. The body 310 may be substantially spherical, cylindrical, or bulbous. A tapered section 312 near one end brings down the walls of the body 310 to a narrowed neck section 314. The neck section 314 has a mouth 316 providing an opening that puts the fluids A and B in fluid communication with one another in or near the neck section 314 at a two-fluid interface 320. In operation, pressure oscillations (acoustic noise) present outside the resonator 325 in fluid A will be felt in or near the neck section 314 of the resonator. Expansion, contraction, pressure variations and other hydrodynamic variables can cause the fluid interface to move about within the area of the neck 314 as illustrated by dashed line 322.

The resonator of FIG. 3 is therefore configured to allow reduction of sound energy in the vicinity of the resonator 325 through Helmholtz resonator oscillations, which depend on a number of factors such as the composition of fluids A and B and the volume of the second fluid B with respect to the volume of the fluids B and/or A in the neck section 314, the cross-sectional area of opening 216, and other factors.

Figure 4:
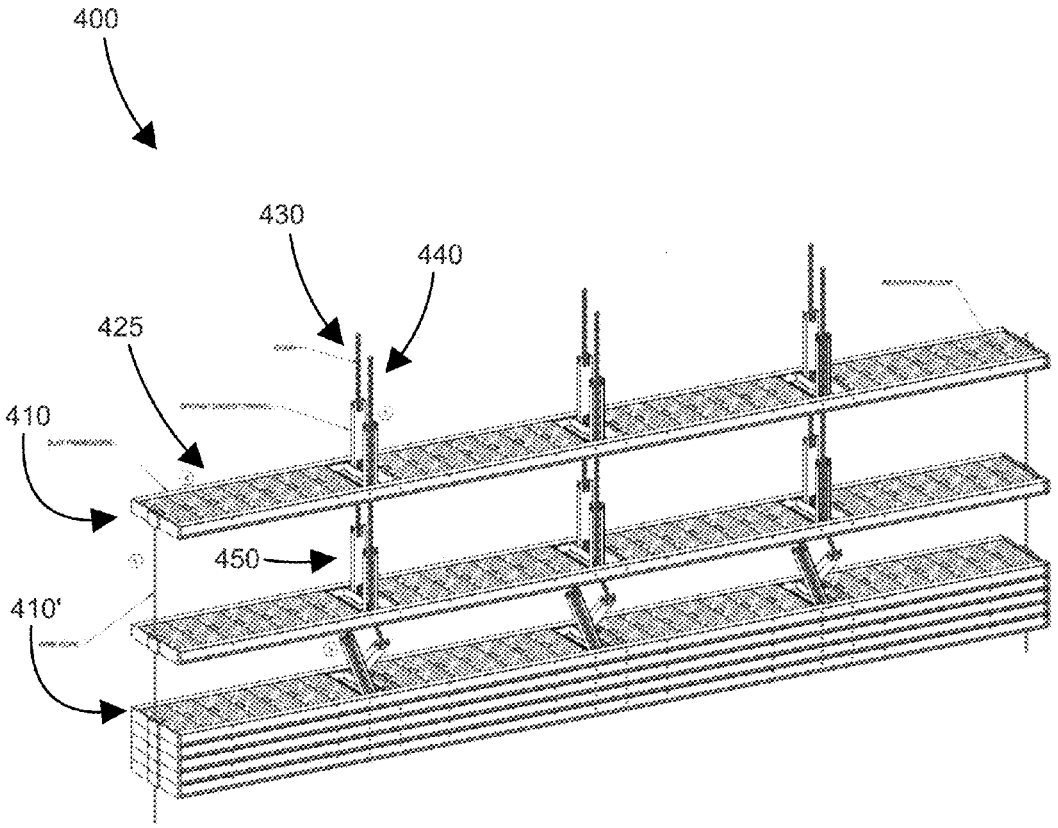
FIG. 4 illustrates a perspective view of a plurality of rows of resonators in a panel according to an embodiment.

FIG. 4 illustrates a perspective view of a plurality of rows 410 of resonators 425 in a panel 400 according to an embodiment. Each row 410 is connected to the adjacent row(s) by a first chain 430 and a second chain 440. The chains 430, 440 are each mechanically connected to a chain guide 450 that can collapse and/or pivot from a vertical or orthogonal position with respect to the plane of row 410 to a horizontal or parallel position with respect to the row. The chain guide 450 connected to row 410' is in a partially deployed (or collapsed) configuration The chain guide 450 can be an elongated support that can be made out of a rigid plastic or a metal (e.g., a corrosion-resistant metal).

Figure 5:
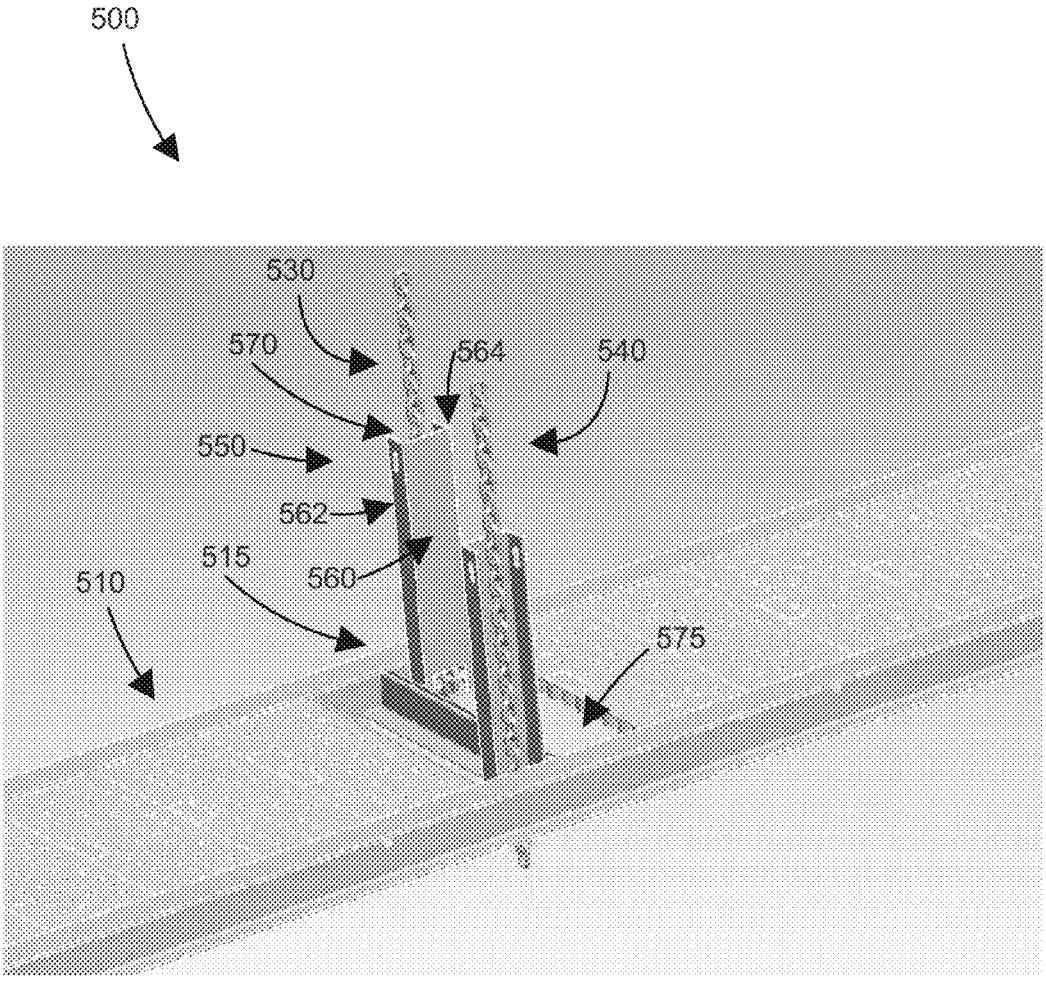
FIG. 5 illustrates a magnified view of the chains and elongated support illustrated in FIG. 4.

FIG. 5 illustrates a magnified view 500 of the chains and elongated support described above. As illustrated, the chains 530, 540 are mechanically connected to a respective guide 550. Each guide 550 has a planar surface 560 with two sidewalls 562, 564 that extend from the planar surface 560 towards the respective chain 530, 540. The sidewalls 562, 564 also extend towards a proximal edge 515 of the row 510 when the elongated support 350 is in a vertical orientation with respect to the row 510. The sidewalls define a recess 570 to receive the chain 330, 340. The recess 570 can have a depth that is greater than or equal to the width of the chain, such that the width of the chain is fully disposed in the recess 570.

A row recess or opening 575 is defined in the row 510 to receive the guide 550 when the guide 550 is in the horizontal/stowed position (i.e., when the length of the guide 550 is parallel to the plane defined by the row 510). The row recess/opening 575 can extend partially or all the way through (e.g., a hole) the depth of the row 510. In some embodiments, the recess/opening 575 extends across the width of the row. In some embodiments, the recess/opening 575 substantially conforms to the shape of the guide 550. The recess/opening 575 can have a depth sufficient to fully receive the guide 550 in the horizontal or stowed position.

Figure 6:
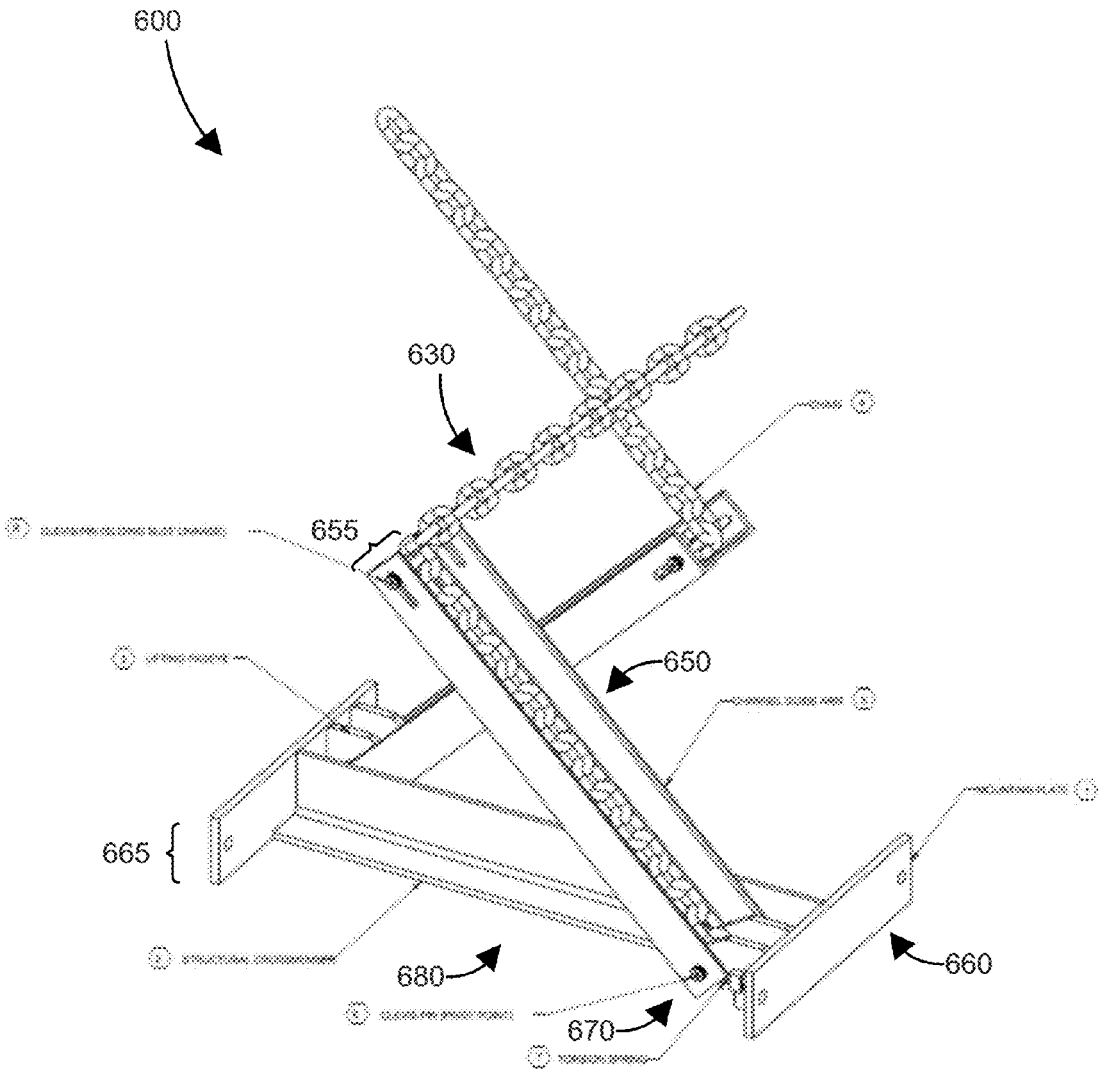
FIG. 6 illustrates a magnified view of chains and chain guides in a partially-collapsed or partially-stowed state.

FIG. 6 illustrates a magnified view 600 of the chains 630 and chain guides 650 in a partially-collapsed or partially-stowed state. The chain guides 650 are disposed on a chain guide apparatus 660. The apparatus 660 includes a structure onto which the guides 650 are attached, for example at pivot point 670 that pivotally connects the apparatus 660 to an end of the guide 650. The apparatus 660 can have a height 665 that is greater than or equal to a depth 655 of the guide 650 such that a recess 680 in the apparatus 660 can fully receive the guide 650 in its horizontal or stowed position. The apparatus 660 can be disposed on a row of a resonator panel, as discussed above, for example in an aperture or hole defined in the row to receive the apparatus 660.

Figure 7:
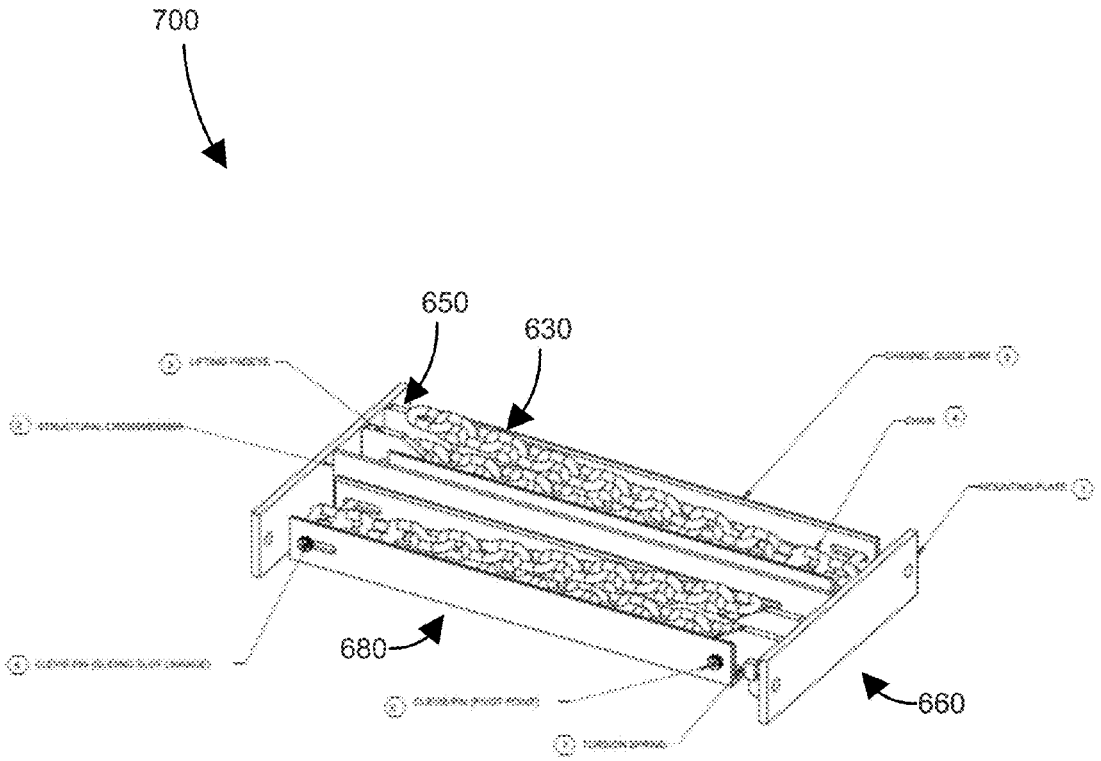
FIG. 7 is a perspective view of chains and chain guides.

FIG. 7 is a perspective view 700 of the chains 630 and guide 650 described above. As illustrated, the guides 650 have pivoted down to the horizontal or stowed position. In the horizontal position, the guides 650 are disposed in the recess 680 of the apparatus 660. If the apparatus 660 is fully disposed in a recess in a row of a resonator panel, as discussed above, the guides 650 lie in the plane defined by the row. The recess 680 that receives the guide 650 allows for a more compact configuration in a collapsed/stowed state, for example when the guides 350 are deployed in a panel having a plurality of rows.

In some embodiments, the chains 7630 are disposed on the inside or unexposed surfaces of the guides 650 (i.e., on the surface of guide 650 that faces the recess 680 when guide 650 is in the horizontal position). In some embodiments, one chain is disposed on the exposed surface of the guide 650 while the other chain is disposed on the inside/unexposed surface of the guide 650.

Figure 8:
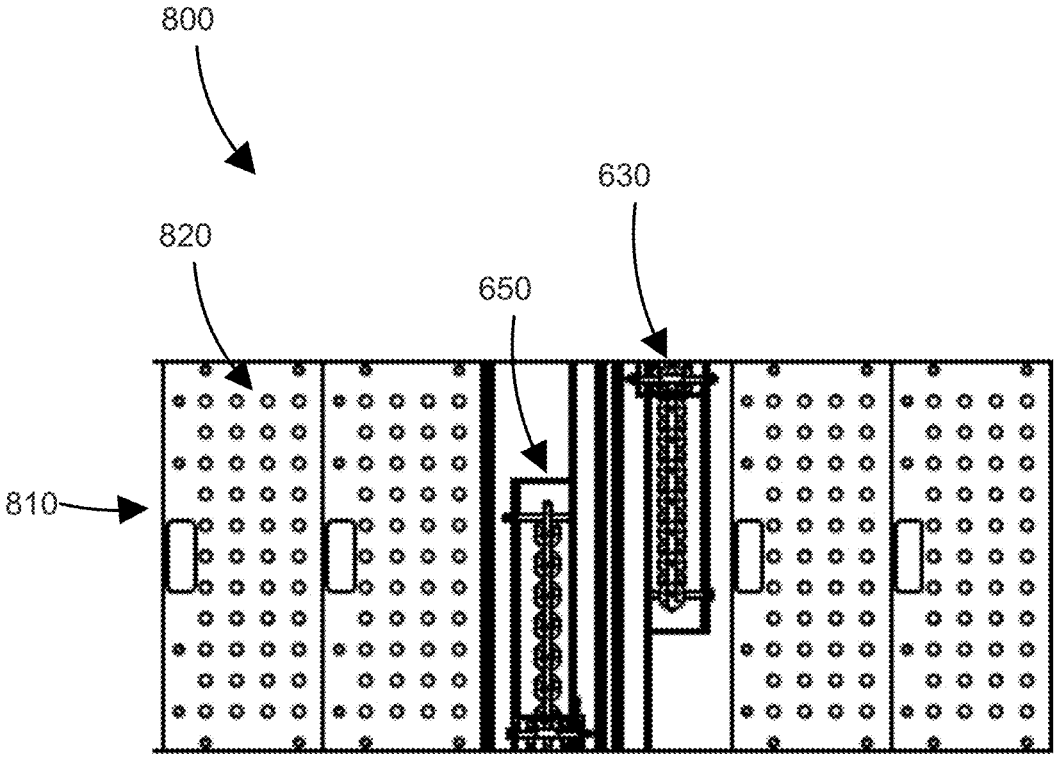
FIG. 8 is a top view of the chain guide illustrated in FIG. 7 disposed in a representative row of resonators.

FIG. 8 is a top view 800 of the chain guide 650 disposed in a representative row 810 of resonators 820. The chains 630 are disposed on the exposed surface of the guides 650 in the illustrated collapsed or stowed configuration.

Figure 9:
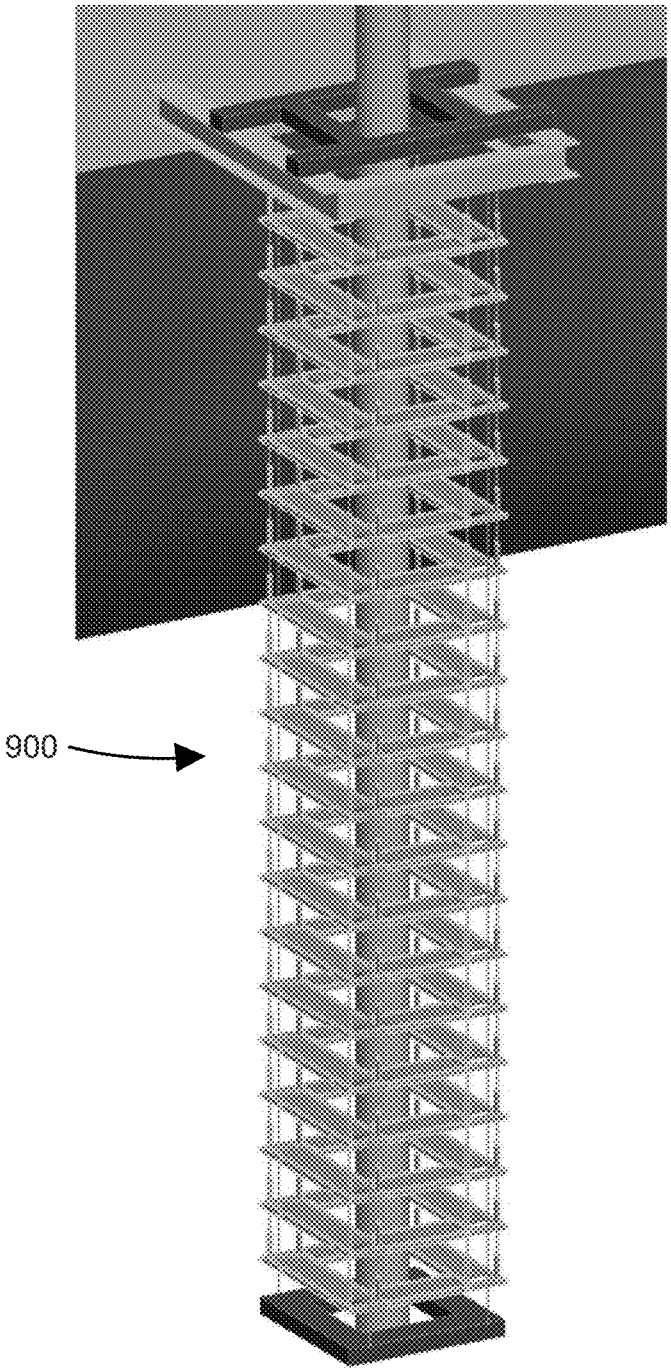
FIG. 9 is a perspective view of a plurality of panels in a deployed configuration.

FIG. 9 is a perspective view of a plurality of panels 900 in a deployed configuration. Each panel 900 includes rows having chains and guides as described above.

Figure 10:
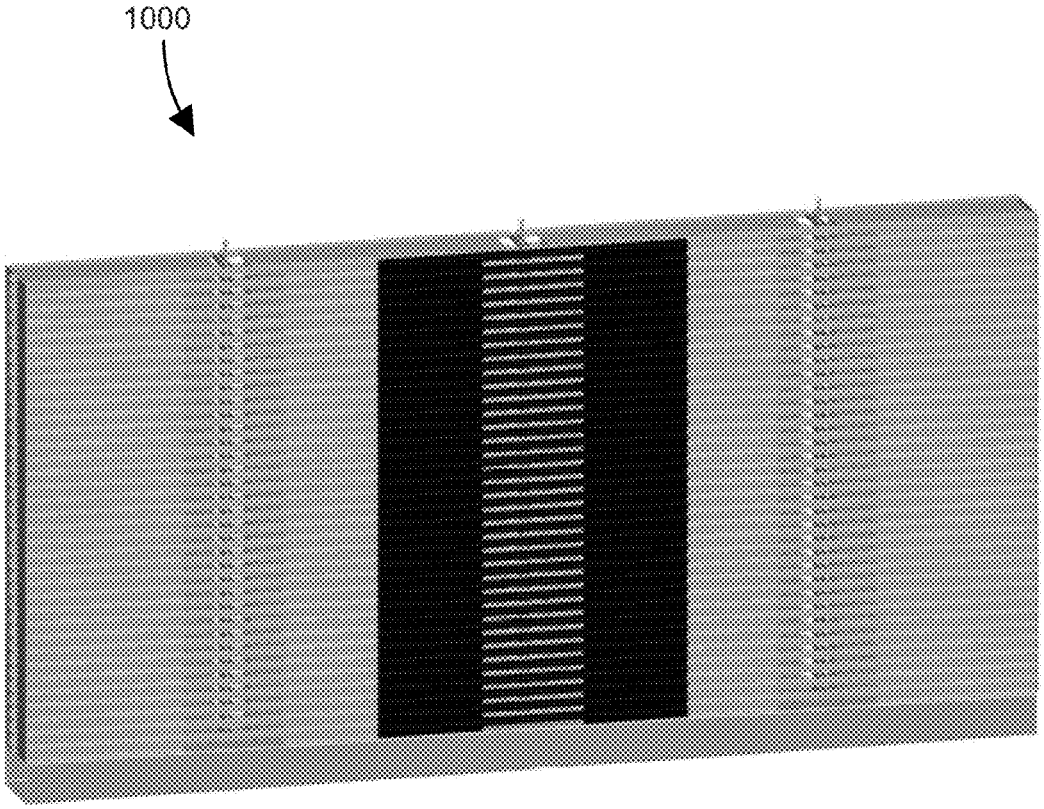
FIG. 10 is a perspective view of a panel in a stowed configuration.

FIG. 10 is a perspective view of a panel 1000 in a stowed configuration. As illustrated, the panel 1000 can be stowed very compactly due to the pivotable/rotatable guide described above.

Figure 11:
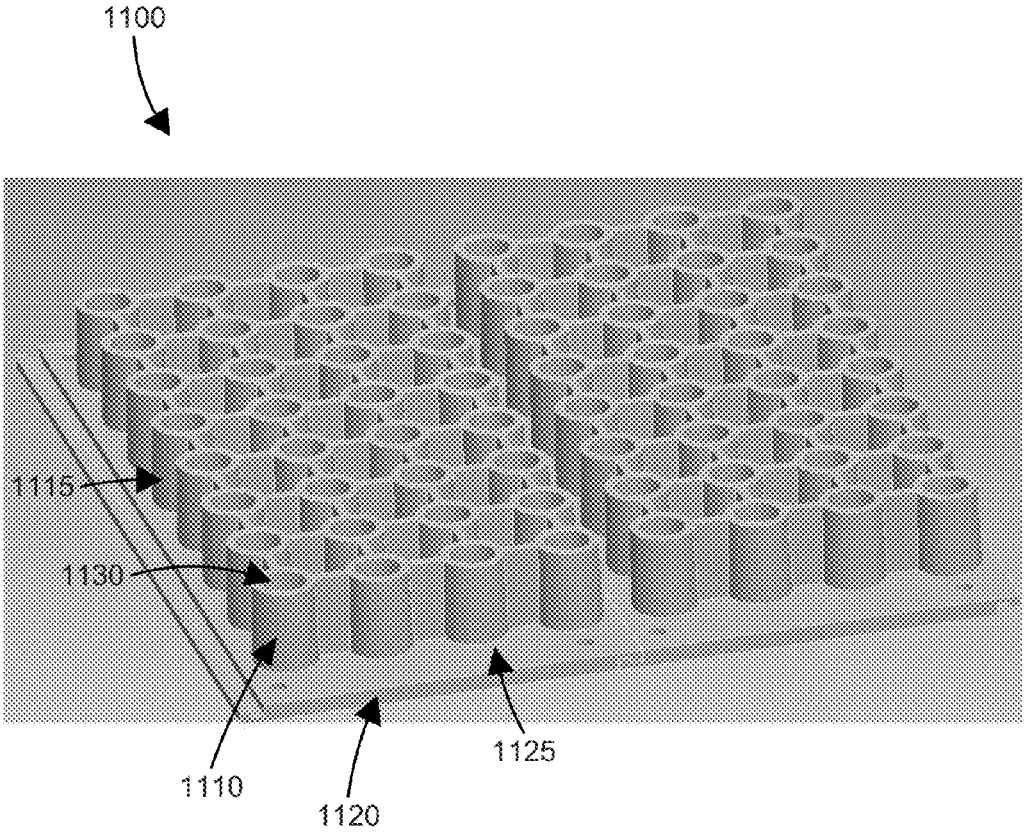
FIG. 11 is a perspective view of an array of resonators in a periodic array.

FIG. 11 is a perspective view of an array 1100 of resonators 1110. The resonators 1110 are disposed on a planar base 1120. The resonators 1110 are generally cylindrical in shape and extend from the base 1120. An aperture 1130 is defined at a distal end of the resonator 1110 from the base 1120. The array 1100 includes a plurality of rows 1115 and columns 1125 or resonators 1110. However, the resonators 1110 can be disposed in other configurations, such as in irregularly spaced and/or irregularly aligned rows 1115 and columns 1125 as described above.

In operation, the resonator array 1100 is deployed in an ocean (or other body of water) with the apertures 1130 of the resonators 1110 facing towards the direction of gravitational pull (i.e., towards the ocean bottom). Such deployment causes air to be trapped between the aperture 1130 and the base 1120 to form a resonating body.

The resonators 1110 can be manufactured by injection molding, for example, using a thermoplastic material. Similar manufacturing processes (e.g., liquid injection molding, reaction injection molding, etc.) are considered and included in this disclosure. In an injection molding process, the resonators 1110 can be integrally connected to the base 1120. The resonators 1110 and base 1120 can be formed of the same material, such as a thermoplastic material as discussed above. By manufacturing the resonators 1110 using injection molding (or similar/equivalent processes), the shape, alignment, orientation, spacing, size, etc. of the resonators 1110 can be varied as desired.

Figure 12:
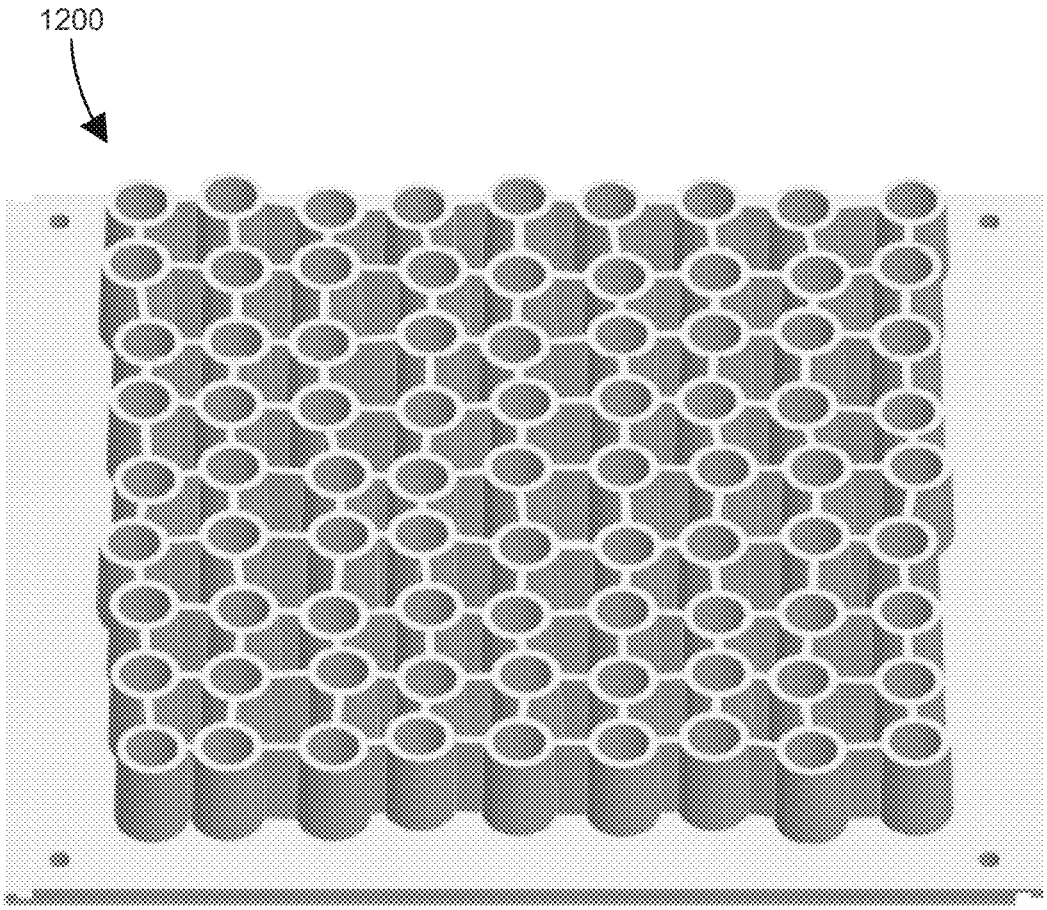
FIG. 12 is a perspective view of an array of resonators in a random or non-periodic array.

For example, the array 1100 can include resonators 1110 having different sizes and/or shapes to enhance the acoustic dampening of the array of resonators. For example, some resonators can have a generally circular cross section while others can have a generally rectangular cross section. In addition or in the alternative, some resonators can have a first aperture size (e.g., a narrow aperture) while other resonators can have a second aperture size (e.g., a wide aperture). In addition, or in the alternative, some resonators can have a first body having a first height and/or a first wall thickness while other resonators can have a second body having a second height and/or a second wall thickness. Such sizes and/or shapes can be regularly or irregularly distributed throughout the array. In addition or in the alternative, the spacing between adjacent resonators can be regular or irregular. In addition or in the alternative, the alignment of resonators in a given row 1115 and/or column 1125 can be regular or irregular, such array 1200 illustrated in FIG. 12.

Figure 13:
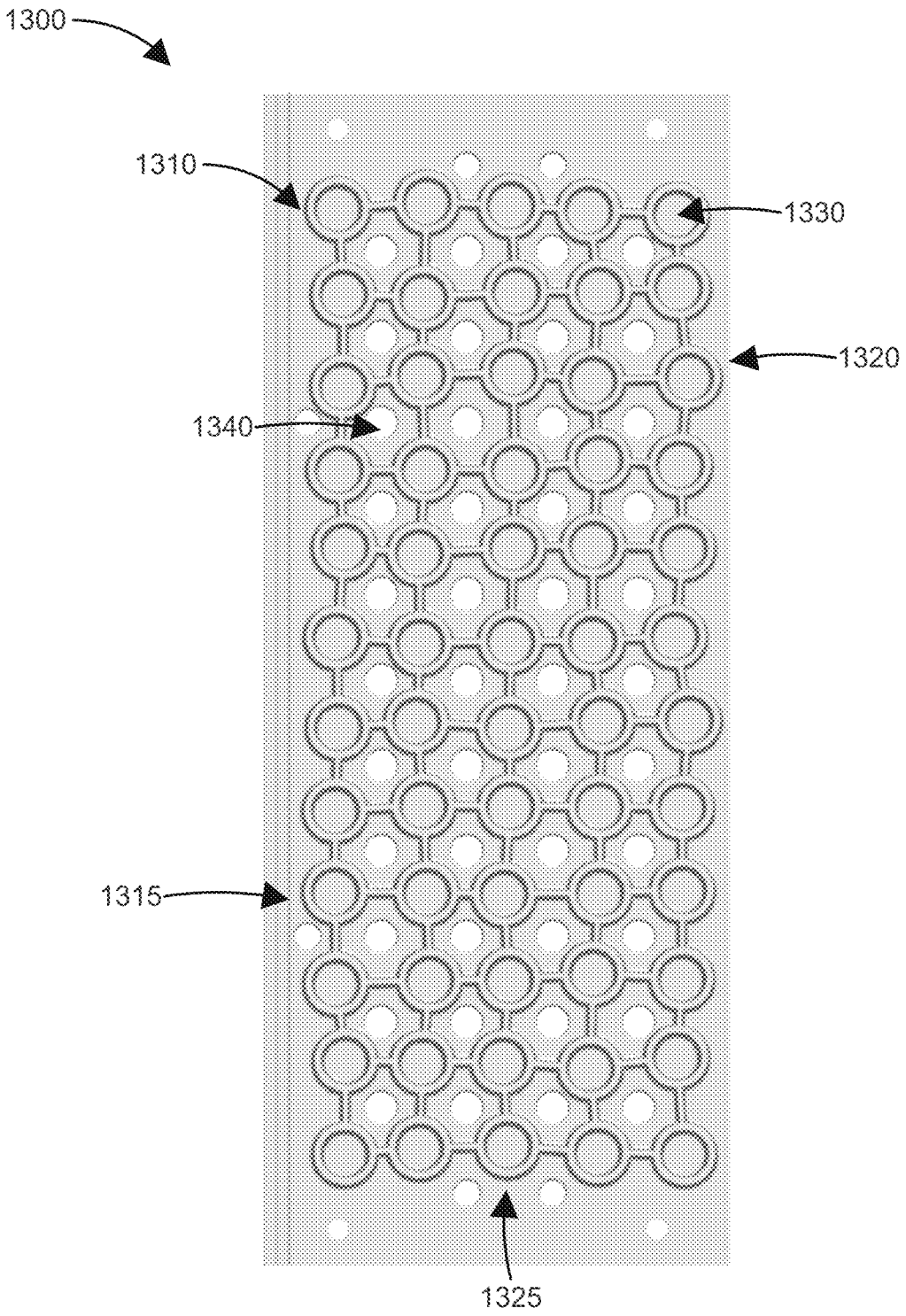
FIG. 13 is a top view of an array of resonators according to an embodiment.

FIG. 13 is a top view of an array 1300 of resonators 1310 according to an embodiment. As illustrated, the resonators 1310 are irregularly spaced or offset and thus not every resonator 1310 is fully aligned in a row 1315 or column 1325. Instead, the spacing of at least some of the resonators 1310 is offset positively or negatively so that some resonators 1310 are spaced closer together to each other while other resonators 1310 are spaced further apart from each other. A plurality of holes 1340 is defined in base 1320 of array 1300. The holes 1340 are disposed between adjacent resonators 1310 and are arranged in columns and rows parallel to columns 1325 and rows 1315 (without the negative/positive offset discussed above). The holes 1340 can facilitate the submersion of the array 1300 into a liquid such as a water body (e.g., a lake or the ocean) by allowing air bubbles to pass through the holes 1625. As the liquid displaces the air bubbles, the array 1300 becomes less buoyant and submerges more readily into the ocean.

In some embodiments, the holes 1340 are only disposed between some adjacent resonators 1310. The holes 1340 can be offset between adjacent resonators 1310 where a hole 1340 is closer to a first resonator 1310 than a second resonator 1310. In addition, or in the alternative, the holes 1340 can be arranged in a regular or irregular pattern. In addition, or in the alternative, the holes 1340 can have different sizes and/or shapes. As discussed above, the array 1300 is deployed in a liquid (e.g., an ocean or other body of water) with the apertures 1330 facing toward the direction of gravitational pull (e.g., toward the bottom of the ocean).

Figure 14:
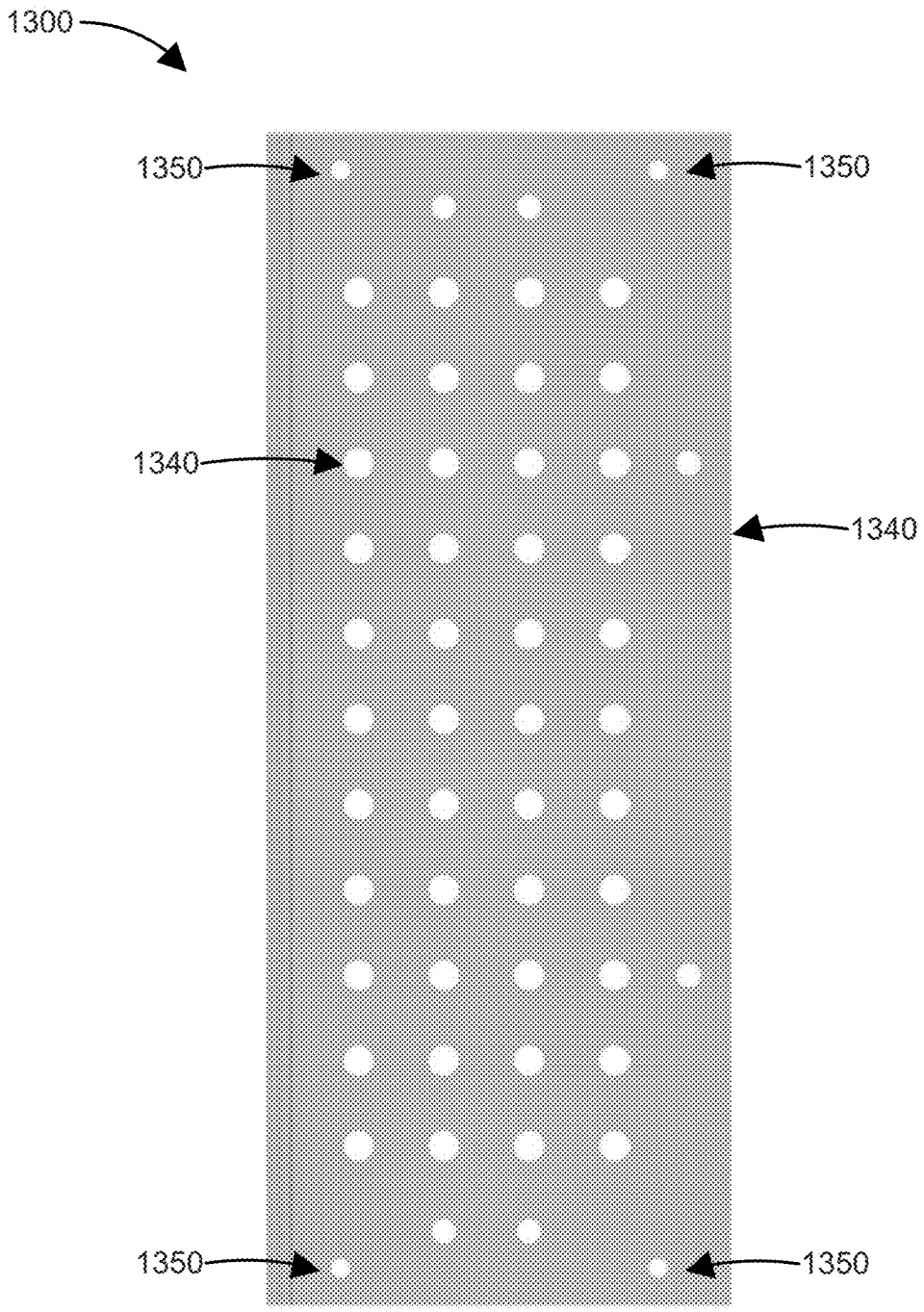
FIG. 14 is a view of the array illustrated in FIG. 13 from an opposing side of the base.

FIG. 14 is a view of the array 1300 from an opposing side of the base 1320. Since the resonators 1310 are on the opposing side of the base 1320, only the holes 1340 are viewable from in this figure. In operation, the exposed surface shown in FIG. 14 would face towards the ocean surface while the opposing side (with the resonators 1310 extending therefrom) would face towards the ocean floor. A second set of holes 1350 is defined in the base 1320 to receive respective lines that are disposed between each array to form a panel of resonators, as described above. The lines can be tethered to a boat or a structure to raise or lower the panel.

Figure 15:
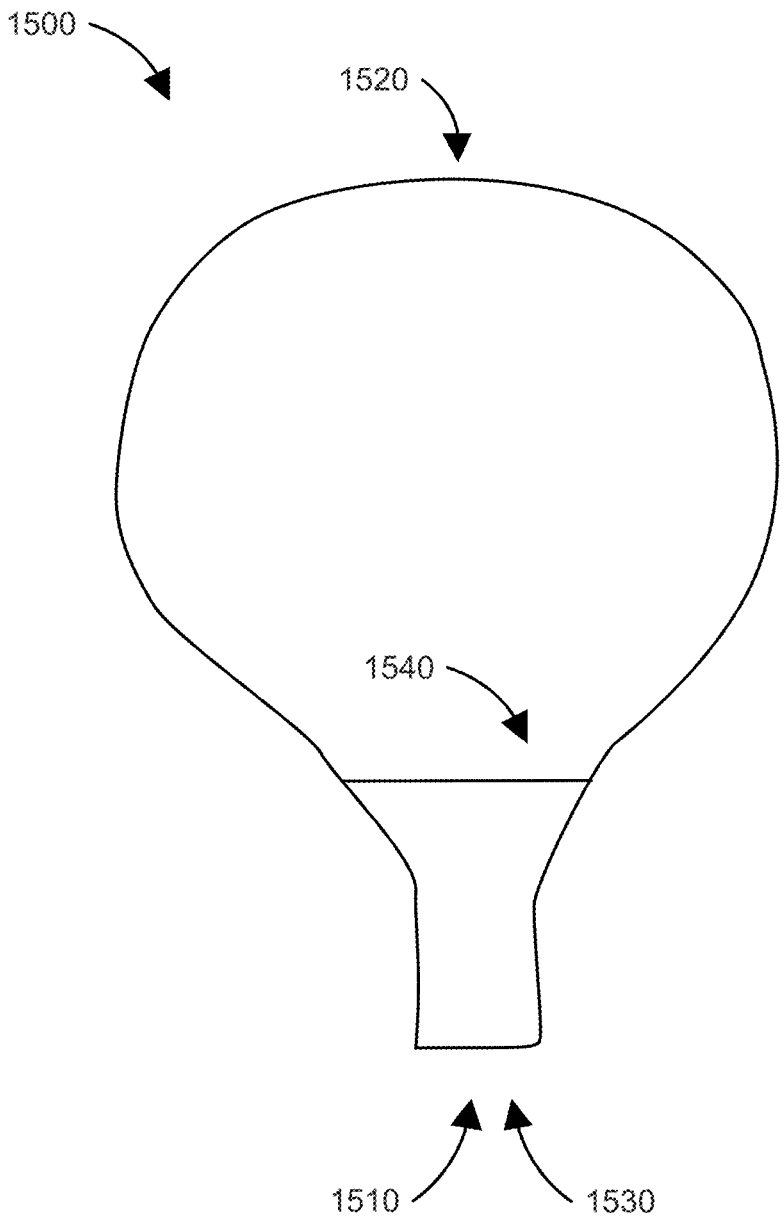
FIG. 15 illustrates a resonator that has a generally balloon-shape in cross section.

FIGS. 15-18 illustrate cross sections of alternative shapes of a resonator according to exemplary embodiments. For example, FIG. 15 illustrates resonator 1500 that has a generally balloon-shape in cross section, with a narrow cross-sectional width at a first end 1510 and a large-cross sectional width at a second end 1520. The first end 1510 includes an aperture 1530 that faces the ocean floor in the deployed orientation. As such, water can enter the aperture and fill a portion of the resonator 1500 up to a water line 1540 which can be a function of the cross-sectional width of the aperture 1530, the cross-sectional width of the the first end 1510, the cross-sectional of the second end 1520, and the depth of deployment of the resonator 1500. As the resonator 1500 is deployed deeper into the ocean, the water pressure on the external surface of the resonator 1500 can increase. The increased water pressure can cause more water to enter the resonator 1500 and thus cause the water line 1540 to be disposed higher in the resonator 1500 (i.e., towards the second end 1520 of the resonator 1500).

As the resonator 1500 fills with water, the effective mass of the resonator 1500 increases. Thus, the effective mass of the resonator 1500 can be customized by varying one or more of the aperture 1530 size, the dimensions (e.g., cross-sectional width) of the resonator 1500 (e.g., the ratio of cross sections at the first and second ends 1510, 1520), and the depth of deployment of the resonator 1500 in the ocean. By adjusting the effective mass, the resonance frequency of the resonator 1500 can be "tuned" to abate a given undersea noise more effectively. In addition, a higher effective mass of the resonator 1500 can have enhanced acoustical dampening properties due to the corresponding higher inertia of the resonator 1500.

Figure 16:
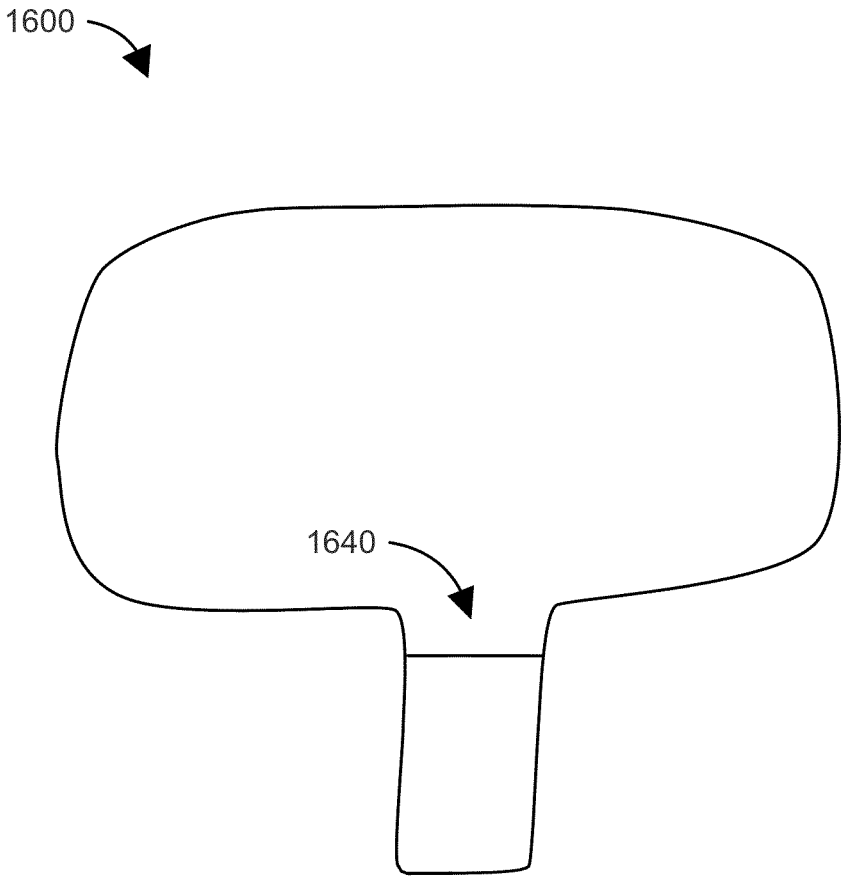
FIG. 16 illustrates a resonator having a generally mushroom-shaped cross section.
Figure 17:
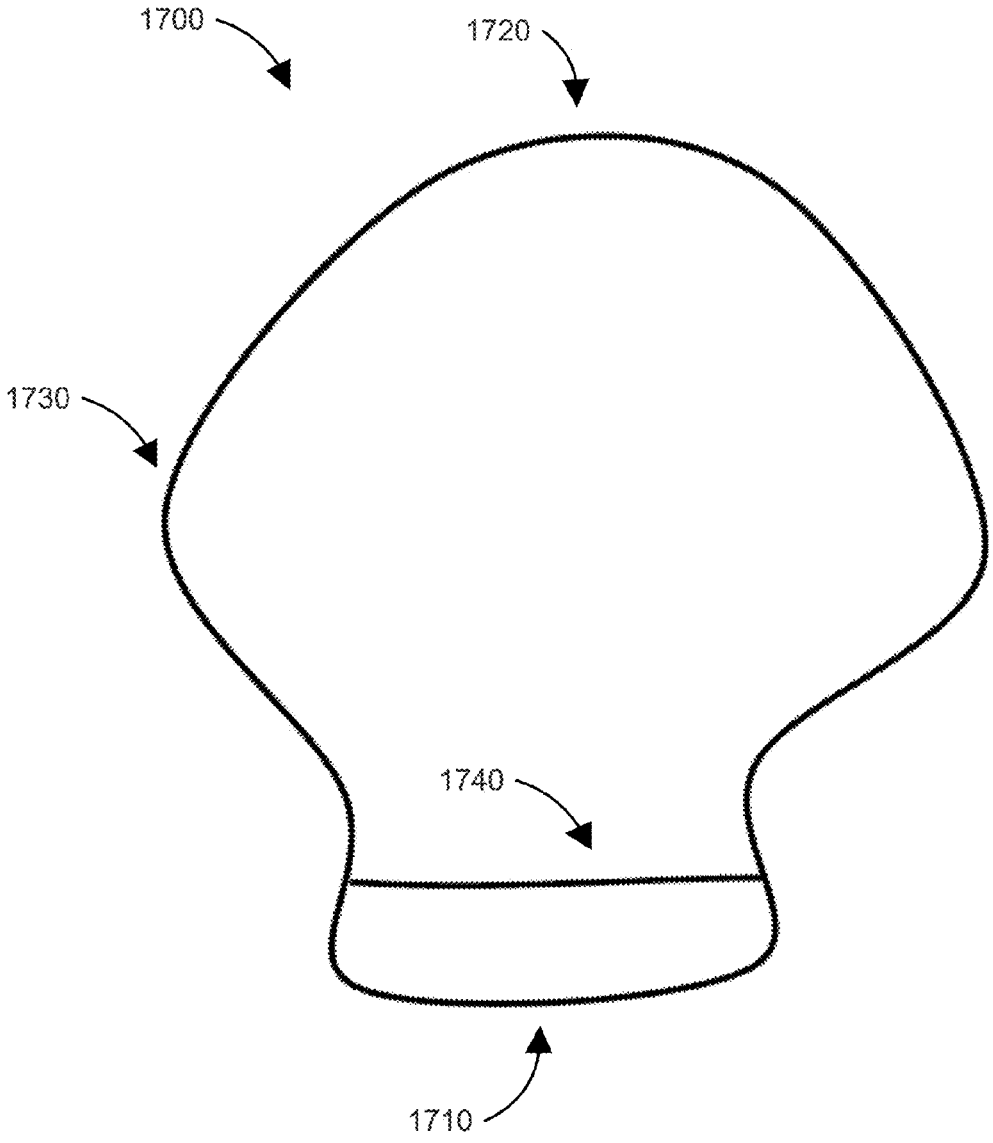
FIG. 17 illustrates a resonator having a wider cross section at its first end than the resonators illustrated in FIGS. 15 and 16.
Figure 18:
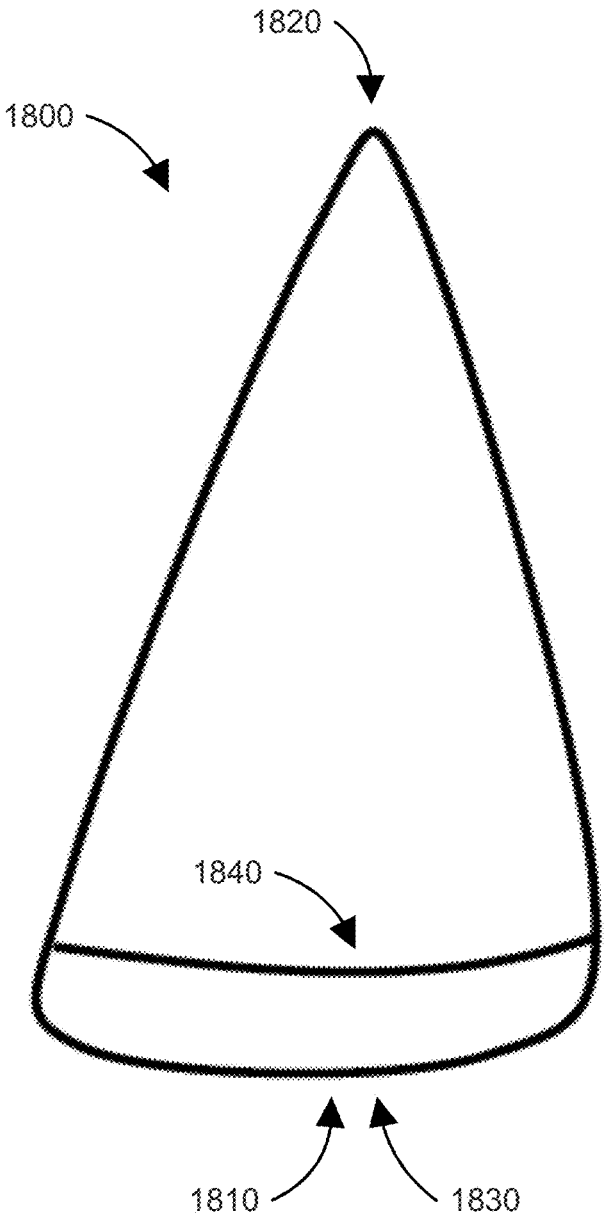
FIG. 18 illustrates a resonator where the cross-sectional width at the first end is greater than the cross-sectional width at the second end.

FIG. 16 illustrates a resonator 1600 having a generally mushroom-shaped cross section with a representative water line 1640. FIG. 17 illustrates a resonator 1700 having a wider cross section at first end 1710 than in FIG. 16 or 17. In addition, the cross-sectional width of the first end 1710 is greater than the cross-sectional width of the second end 1720, and the cross-sectional width of a middle portion 1730 is greater than the cross-sectional width of the first and second ends 1710, 1720. A representative water line 1740 is also illustrated in FIG. 17. FIG. 18 illustrates a resonator 1800 where the cross-sectional width at the first end 1810 is greater than the cross-sectional width at the second end 1820. In general, resonator 1800 has a shape similar to a cone. The wider cross-sectional width at the first end 1810 (and corresponding wider aperture 1830) can cause the water line 1840 to be lower (i.e., closer to the first end/aperture) compared to resonators 1500, 1600, or 1700. It is noted that the cross-sectional shapes illustrated in FIGS. 15-18 are provided as examples and the disclosure contemplates any and all cross-sectional arrangements and shapes of resonators. In addition, the resonators illustrated in FIGS. 15-18 can be generally circular or oval, rectangular, symmetrical, or asymmetrical in a second cross section orthogonal to the cross-sectional plane illustrated in FIGS. 15-18.

The resonators 1500, 1600, 1700, and/or 1800 can be integrated into an array, for example as illustrated in FIGS. 11-14. Such an array can be homogenous (e.g., the array includes the resonators having the same or similar shape) or inhomogeneous (e.g., the array includes various shapes, such as both the resonators 1600 and 1900). The spacing between adjacent resonators, alignment or offsetting of resonators in rows/columns, and/or size of the resonators can be adjusted or varied as described above, for example to reduce or increase the acoustical resonance of the array. In addition, or in the alternative, a panel of arrays can include a first panel having a first array with a first shape of resonators and a second array with a second shape of resonators. In addition, or in the alternative, the panel can include at least one inhomogeneous array and/or at least one homogenous array. Multiple panels can be deployed with the same or different resonator configuration, which can increase the spectrum of resonance frequencies to provide for enhanced noise abatement and/or enhanced acoustical performance (e.g., due to decreased resonance/echoing between panels).

Figure 19:
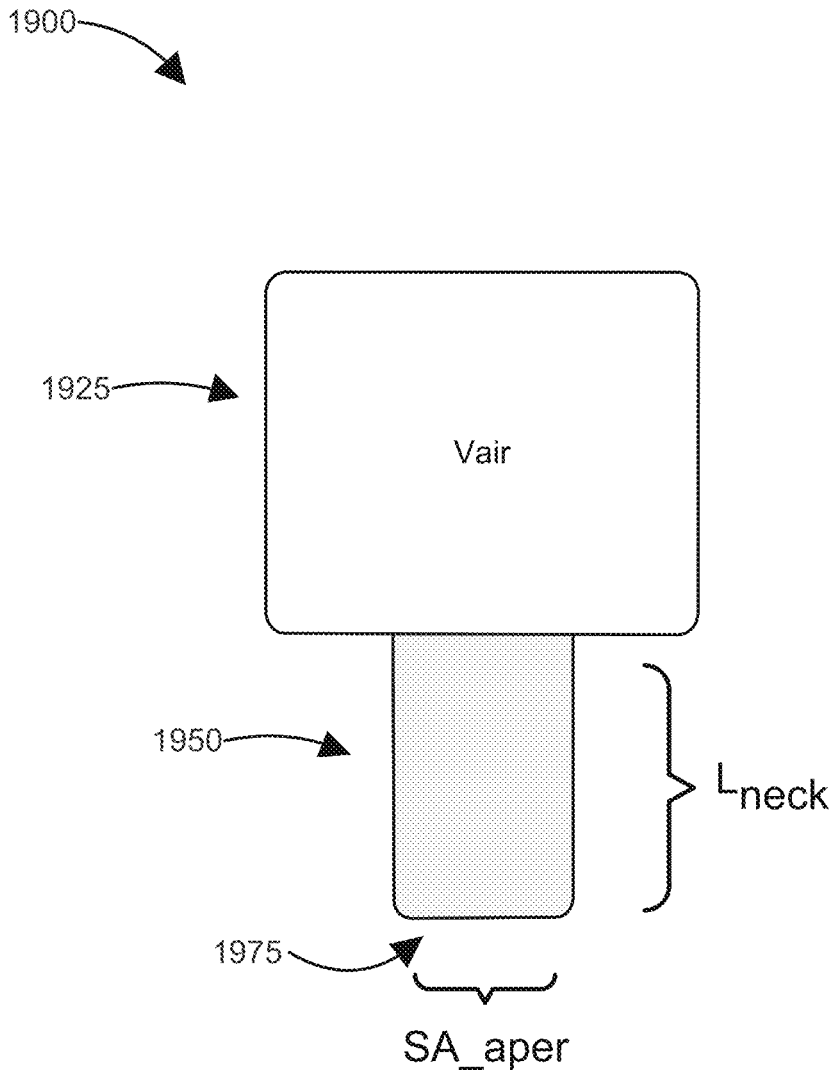
FIG. 19 illustrates a simplified representation of a resonator.

FIG. 19 illustrates a simplified representation of a resonator 1900. The resonator 1900 includes a hollow cavity 1925 and a neck portion 1950 having an aperture 1975. The hollow cavity 1925 is configured to retain a volume of air, Vair, while the resonator 1900 is deployed in a liquid (e.g., water) and the neck portion 1950 is oriented towards a direction of gravitational pull (e.g., towards the bottom of the ocean). When the resonator 1900 is in the deployed state, the neck portion 1950 fills at least partially with the liquid. Thus, the resonator 1900 can function as a two-fluid Helmholtz resonator.

The acoustic behavior of the resonator is governed by the gas volume (Vair), the length of the neck portion 1950 filled with the liquid (Lneck), and the surface area (SA_aper) of the aperture 1975. The gas volume (Vair) and the length of the neck portion 1950 filled with the liquid (Lneck) are dependent on the pressure exerted on the resonator 1900 by the liquid (e.g., water pressure), which is a function of the depth of deployment of the resonator 1900. The depth dependence of these parameters can cause the resonance frequency and acoustic dampening of the resonator 1900 to also be depth-dependent. The relationship between resonance frequency, deployment depth, Vair, Lneck, and SA_aper may be mathematically modeled as would be appreciated by those skilled in the art.

Figure 20:
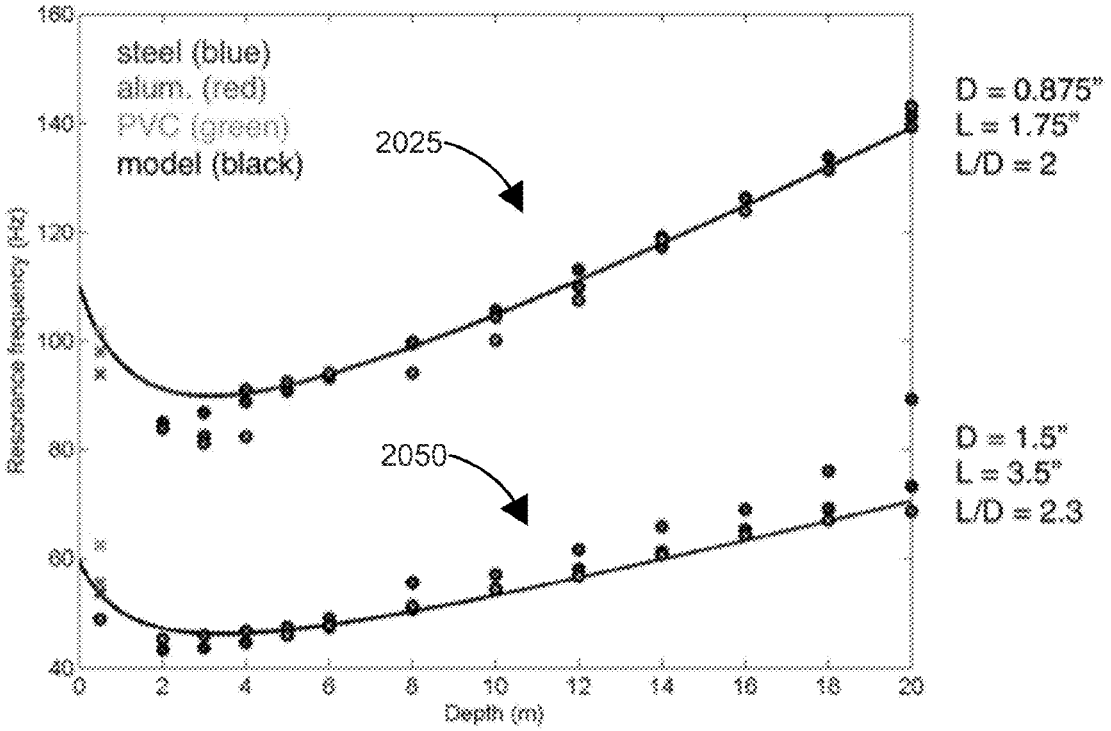
FIG. 20 is a graph illustrating a comparison of the mathematic model versus experimental data of resonance frequency versus depth of deployment of a resonator.

A comparison of the mathematic model versus experimental data of resonance frequency versus depth of deployment is illustrated in FIG. 20. The comparison is repeated for a first resonator size 2025 and a second resonator size 2050 as illustrated on the right-hand side of the figure. The experimental data was taken in a tank (data points with "x's") and in a fresh water lake (data points with circles) using resonators made of different materials (steel, aluminum, and PVC).

Figure 21:
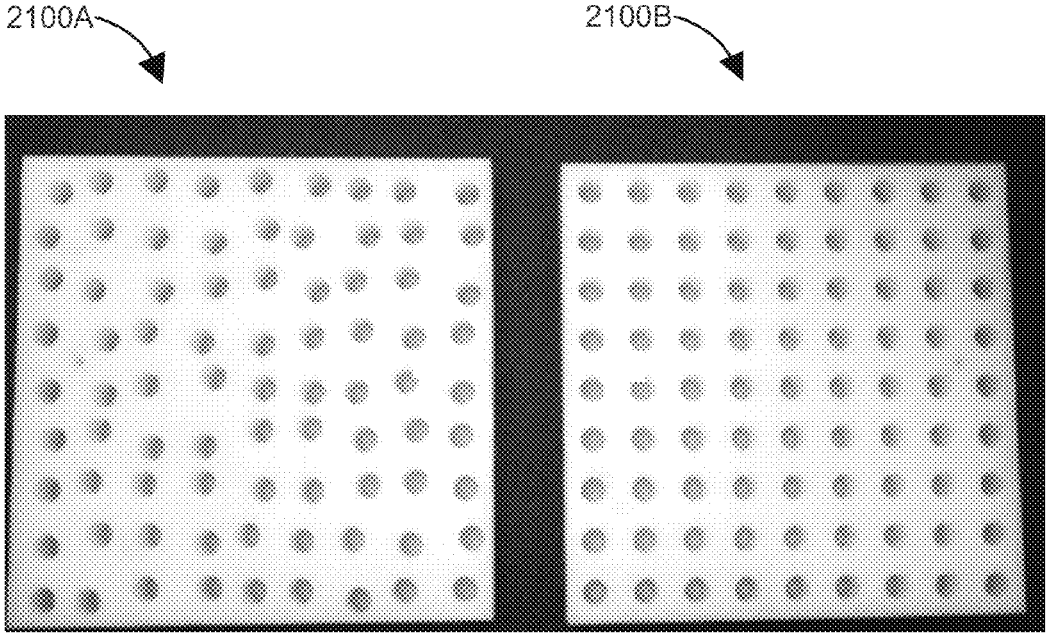
FIG. 21 illustrates a prototype of a randomized resonator assembly and a periodic resonator assembly.

FIG. 21 illustrates a prototype of randomized resonator assembly 2100A and a periodic resonator assembly 2100B that incorporate the resonators described herein. The assemblies were fabricated on an automated router using 2 inch by 16 inch by 16 inch blocks of ultrahigh molecular weight polyethylene (UHMW PE). The internal dimensions of each individual resonator were 0.875 inch diameter and 1.75 inch height, which corresponds to a resonance frequency near 100 Hz when deployed within the first few meters of a liquid. The resonators' positions in the random array 2100A were generated by perturbing the periodic array positions with a pseudorandom number generator as described below.

For ease of manufacturing and assembly, an array of individual resonator cavities was designed into a single unit part. The part can be described as a flat plate with a discrete number of hollow, cylindrical protrusions that are open to the atmosphere on the end opposite of the plate. Each protrusion forms a single resonator. The placement of the resonators on the face of the plate can be determined by pseudo-random perturbations to a square grid. A unit length in the square grid can be set to be twice that of the inner diameter of the resonators. A pseudo-random number generator can be used to determine a 2-dimensional (i.e., in an x-y plane perpendicular to the protrusions) perturbation of each node in the grid. The magnitude of the perturbation can be limited such that the outer diameters of adjacent resonators do not come into contact. With these factors, the center axis of each resonator can be defined as a specific perturbed node.

Figure 22:
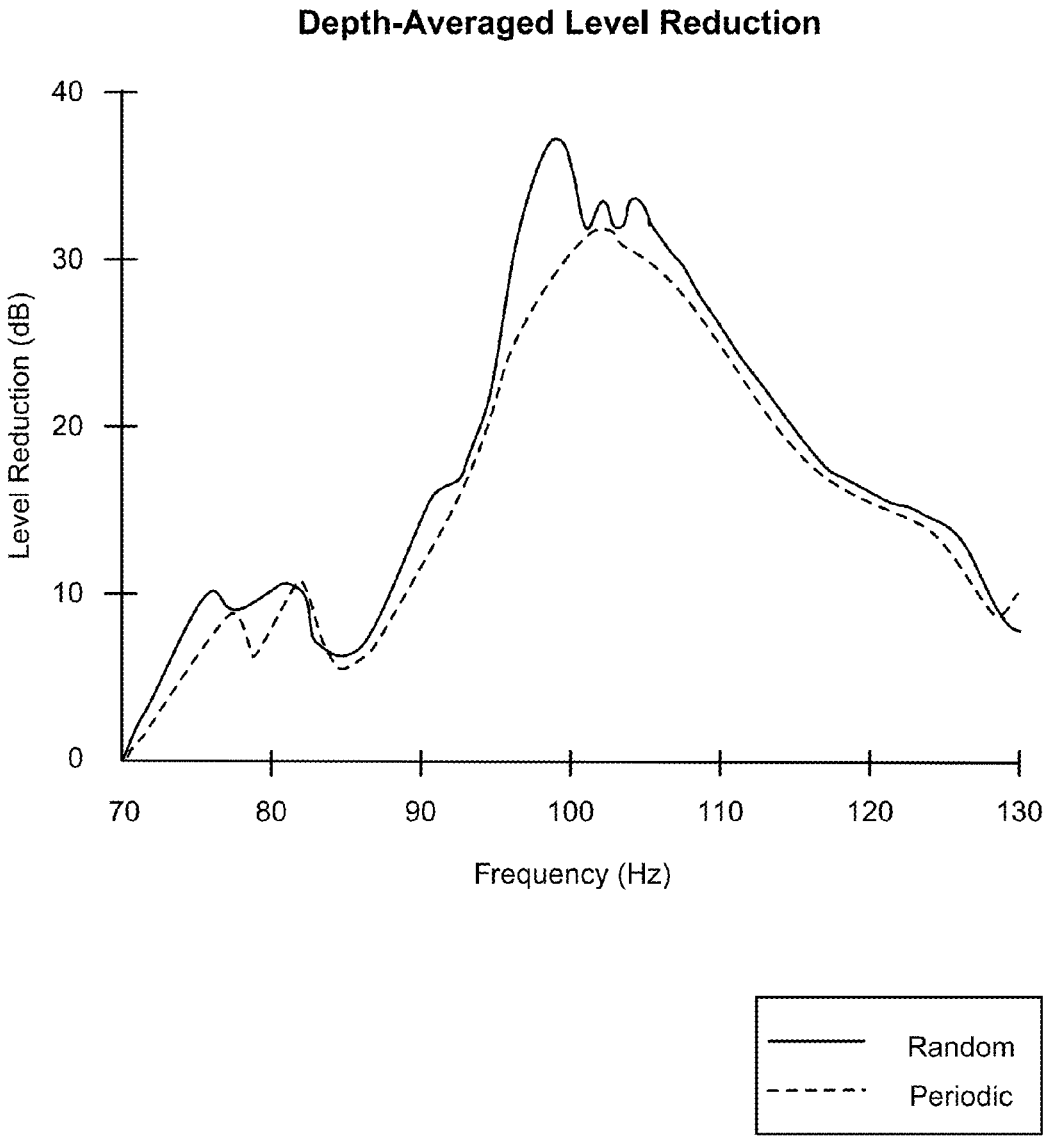
FIG. 22 is a graph illustrating a comparison of the random versus. periodic resonator assembly sound reduction measured in a test.

As described above, the spatial structure of the resonator array can have an effect on the sound transmitted through or radiated by the array. The sound transmission or radiation can either by enhanced or inhibited by the array depending on the structure. Randomizing the locations of the resonators in the array can help to ensure that the phases of the scattered and re-radiated sound waves passing through the array are incoherent so that the net transmission of sound is minimized. In an experiment, the randomized resonator assembly 2100A achieved about 6 dB more sound reduction than the periodic resonator assembly 2100B near the individual resonator resonance frequency, which was about 85 Hz at the test water depth. A comparison of the random vs. periodic resonator assembly sound reduction measured in the test is illustrated in FIG. 22.

Those skilled in the art will appreciate upon review of the present disclosure that the ideas presented herein can be generalized, or particularized to a given application at hand. As such, this disclosure is not intended to be limited to the exemplary embodiments described, which are given for the purpose of illustration. Many other similar and equivalent embodiments and extensions of these ideas are also comprehended hereby.

What is claimed is:

1. A resonator for damping acoustic energy from a source in a liquid, the resonator comprising:

a base having a first planar surface and a second planar surface, said first and second planar surfaces parallel with one another; and a hollow body having, in a cross section orthogonal to said second planar surface of said base, a first end, a second end, and a sidewall therebetween, said second end integrally connected to said second surface of said base, said body extending away from said second planar surface of said base into a space exterior to said base, said body having an aperture defined in said first end, said aperture extending from said first end to said second end, said aperture defining a volume in said hollow body, said hollow body configured to retain a gas in said volume when said resonator is disposed in said liquid while said aperture is aligned with a direction of gravitational pull.

2. The resonator of claim 1, wherein said hollow body has a first portion and a second portion, said first portion disposed proximal to said first end, said second portion disposed proximal to said second end, wherein said first portion is narrower than said second portion.

3. The resonator of claim 1, wherein said base and said hollow body are formed out of a same material.

4. The resonator of claim 3, wherein said same material comprises a thermoplastic material.

5. The resonator of claim 1, wherein said hollow body is in a shape of a balloon.

6. The resonator of claim 1, wherein said hollow body is in a shape of a mushroom.

7. The resonator of claim 1, wherein a ratio of a width of said first portion and a ratio of a width of said second portion is selected based on a depth of deployment of said resonator in said liquid.

8. The resonator of claim 7, wherein said ratio is selected so that a desired volume of said liquid enters said volume at said depth.

9. The resonator of claim 8, wherein said resonator has a resonance frequency based at least in part on said desired volume of liquid.

10. An apparatus for damping acoustic energy from a source in a liquid, the apparatus comprising:

a base having a first planar surface and a second planar surface, said first and second planar surfaces parallel with one another;

a plurality of hollow bodies, each hollow body having, in a cross section orthogonal to said second planar surface, a first end, a second end, and a sidewall therebetween, said second end integrally connected to said second surface of said base, said body having an aperture defined in said first end, said aperture extending from said first end to said second end, said aperture defining a volume in said hollow body, said hollow body configured to retain a gas in said volume when said resonator is disposed in said liquid while said aperture is aligned with a direction of gravitational pull; and a plurality of holes defined in said base, said holes disposed between at least some of said hollow bodies.

11. The apparatus of claim 10, wherein said holes are configured to allow a gas bubble to pass through when apparatus is submerged in said liquid to reduce a buoyancy of said apparatus.

12. The apparatus of claim 10, wherein said resonators are arranged in an array having a plurality of columns and rows.

13. The apparatus of claim 12, wherein at least some of said resonators are offset from said columns or rows.

14. The apparatus of claim 12, wherein said resonators include a first resonator having a first shape and a second resonator having a second shape, said first shape different than said second shape.

15. The apparatus of claim 14, wherein said first and second resonators are randomly distributed in said array.

16. The apparatus of claim 12, wherein said resonators include a first resonator having a first height and a second resonator having a second height.

17. The apparatus of claim 12 wherein a distance between adjacent resonators is variable throughout said array.

18. The apparatus of claim 12 wherein said distance is randomly distributed throughout said array.

19. A noise abatement system comprising:

a plurality of collapsible frames;

a chain passing through an aperture defined in each collapsible frame, said chain mechanically connecting and supporting said collapsible frames;

a plurality of elongated chain guards, each chain guard pivotally connected to said frame proximal to said aperture, said chain guard having a body that defines a recess along a length of said chain guard to at least partially receive the chain, said chain guard configured to pivot (a) from an open position wherein said length of said chain guard is orthogonal to said respective frame (b) to a closed position wherein said length of said chain guard is parallel to said respective frame; and a plurality of resonators disposed on each said frame, each resonator including a hollow body having an open end, a closed end, and a sidewall therebetween, said closed end integrally connected to a first surface of a base disposed on said respective frame.

20. The system of claim 19, wherein said body has an aperture defined in said open end and extending from said open end to said closed end, said aperture defining a volume in said hollow body, said hollow body configured to retain a gas in said volume when said resonator is submerged in a liquid while said aperture is aligned with a direction of gravitational pull.

21. The system of claim 19, wherein said body has a first portion and a second portion, said first portion disposed proximal to said open end, said second portion disposed proximal to said closed end, wherein said first portion is narrower than said second portion.

22. The system of claim 19, wherein said resonators are spaced irregularly on at least one frame.

23. The system of claim 19, wherein said resonators have a plurality of shapes and/or sizes.

24. The system of claim 23, wherein said plurality of shapes and/or sizes is randomly distributed on at least one frame.

25. The system of claim 19, wherein said system is configured to collapse from a deployed configuration to a stowed configuration, said deployed configuration having said frames in an extended position so that said frames are spaced further apart from one another than they would be when stowed, and said stowed configuration having said frame in a contracted position so that said resonators are spaced closer together than they would be when deployed.

26. The system of claim 25, wherein said chain guard is in said open position when said system is in said deployed configuration and said chain guard is in said closed position when said system is in said stowed configuration.

27. The system of claim 19, wherein a plurality of holes is defined in said base, said holes disposed between at least some of said resonators.

* * * * *